US010986896B2

(12) United States Patent
Lussier et al.

(10) Patent No.: US 10,986,896 B2
(45) Date of Patent: Apr. 27, 2021

(54) ARTICLE OF FOOTWEAR WITH RIBBED OUTSOLE AND NOTCHED MIDSOLE

(71) Applicant: adidas AG, Herzogenaurach (DE)

(72) Inventors: Michel Reginald Lussier, Portland, OR (US); Matteo Edmond Padovani, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 15/877,083

(22) Filed: Jan. 22, 2018

(65) Prior Publication Data

US 2019/0223553 A1 Jul. 25, 2019

(51) Int. Cl.
*A43B 13/22* (2006.01)
*A43B 13/12* (2006.01)

(52) U.S. Cl.
CPC ..... *A43B 13/223* (2013.01); *A43B 13/122* (2013.01); *A43B 13/125* (2013.01)

(58) Field of Classification Search
CPC ... A43B 13/122; A43B 13/145; A43B 3/0047; A43B 7/144; A43B 7/1425
USPC ..... 36/3 A
See application file for complete search history.

(56) References Cited

U.S. PATENT DOCUMENTS 4,267,650 A * 5/1981 Bauer ..... A43B 13/36 36/101
4,676,010 A 6/1987 Cheskin
4,685,224 A * 8/1987 Anger ..... A43B 17/08 36/43
4,779,361 A 10/1988 Kinsaul
5,595,004 A 1/1997 Lyden et al.
6,082,023 A * 7/2000 Dalton ..... A43B 13/187 36/103
7,178,271 B2 * 2/2007 Covatch ..... A43B 13/141 36/102
7,398,608 B2 7/2008 Schoenborn
7,574,817 B2 8/2009 Fechter
7,594,345 B2 9/2009 Fusco
7,946,058 B2 5/2011 Johnson et al.
7,966,751 B2 6/2011 Durand
8,567,097 B2 10/2013 Edy et al.
9,271,541 B2 * 3/2016 Biancucci ..... B29D 35/061
9,289,028 B1 3/2016 Anderson
9,451,806 B2 * 9/2016 Baker ..... A43B 7/144
2002/0017036 A1 * 2/2002 Berger ..... A43B 13/186 36/3 B
2005/0223594 A1 * 10/2005 Issler ..... A43B 7/08 36/3 B (Continued)

FOREIGN PATENT DOCUMENTS

CN 101351131 A 1/2009
CN 201691172 U 1/2011

(Continued)

OTHER PUBLICATIONS

"region" Collins. Web. https://www.collinsdictionary.com/US/dictionary/english/region.*

*Primary Examiner* — Jillian K Pierorazio
(74) *Attorney, Agent, or Firm* — Sterne, Kessler, Goldstein & Fox P.L.L.C.

(57) ABSTRACT

A sole for an article of footwear includes an outsole that has longitudinal ribs and a midsole that is disposed above the outsole and that defines notches. The longitudinal ribs are disposed in the notches.

15 Claims, 10 Drawing Sheets

(56) References Cited

U.S. PATENT DOCUMENTS

| | | | | |
|---|---|---|---|---|
| 2006/0021260 | A1* | 2/2006 | Kim | A43B 13/36 36/130 |
| 2006/0254093 | A1 | 11/2006 | Fuchslocher et al. | |
| 2007/0220778 | A1 | 9/2007 | Fusco et al. | |
| 2007/0240333 | A1* | 10/2007 | Le | A43B 17/10 36/30 R |
| 2008/0229617 | A1 | 9/2008 | Johnson et al. | |
| 2008/0289215 | A1* | 11/2008 | Park | A43B 7/144 36/28 |
| 2013/0081304 | A1* | 4/2013 | Abshire | A43B 13/181 36/28 |
| 2013/0185955 | A1 | 7/2013 | Cheng | |
| 2013/0219755 | A1* | 8/2013 | Polegato Moretti | A43B 7/08 36/3 A |
| 2013/0318828 | A1* | 12/2013 | Sink | A43B 13/14 36/103 |
| 2014/0223777 | A1 | 8/2014 | Whiteman et al. | |
| 2017/0027282 | A1 | 2/2017 | Santos et al. | |
| 2017/0035143 | A1* | 2/2017 | Sato | A43B 13/026 |

FOREIGN PATENT DOCUMENTS

| | | | |
|---|---|---|---|
| CN | 203841199 | U | 9/2014 |
| CN | 205321402 | U | 6/2016 |
| CN | 105831875 | A | 8/2016 |
| CN | 106604657 | A | 4/2017 |
| DE | 10 2011 008 664 | A1 | 6/2011 |
| FR | 3 008 587 | A1 | 1/2015 |
| FR | 3 036 927 | A1 | 12/2016 |
| GB | 2 351 005 | B | 10/2002 |
| JP | 3613515 | B2 | 11/2004 |
| JP | 4286070 | B2 | 4/2009 |
| JP | 4745401 | B2 | 5/2011 |
| JP | 2014-151210 | | 8/2014 |
| JP | 2017-35170 | | 2/2017 |
| JP | 2017029668 | A | 2/2017 |
| WO | WO 2006/031005 | A1 | 3/2006 |
| WO | WO 2007/074978 | A1 | 7/2007 |
| WO | WO 2010/003467 | A1 | 1/2010 |

* cited by examiner

ARTICLE OF FOOTWEAR WITH RIBBED OUTSOLE AND NOTCHED MIDSOLE

BACKGROUND

Field

Embodiments of the present invention relate generally to articles of footwear; and more specifically, to articles of footwear with a ribbed outsole and a notched midsole.

Background

Articles of footwear are used to enhance the wearer's walking and/or running experience. For example, a sole may provide cushioning, support, and stability that enhance the heel-to-toe transition of the gait cycle. Improvements to soles and articles of footwear that provide the desired characteristics to enhance the wearer's experience are desirable.

BRIEF SUMMARY

Articles of footwear with a ribbed outsole and a notched midsole are disclosed. In some embodiments, a sole for an article of footwear includes an outsole that has longitudinal ribs and a midsole that is disposed above the outsole and that defines notches. In some embodiments, the longitudinal ribs are disposed in the notches.

In some embodiments, the outsole has five longitudinal ribs. In some embodiments, the longitudinal ribs are disposed in a forefoot region of the sole. In some embodiments, the longitudinal ribs are disposed in a midfoot region of the sole. In some embodiments, the longitudinal ribs are disposed in a rearfoot region of the sole. In some embodiments, the longitudinal ribs have an equal length to each other. In some embodiments, at least one of the longitudinal ribs has a length different than another longitudinal rib.

In some embodiments, an article of footwear includes an upper, a midsole coupled to the upper that defines notches in its bottom surface, and an outsole coupled to the midsole that has longitudinal ribs extending from its top surface. In some embodiments, each longitudinal rib is disposed in one of the notches.

In some embodiments, the longitudinal ribs are disposed in a forefoot region of the article of footwear. In some embodiments, the longitudinal ribs are disposed only in a forefoot region of the article of footwear. In some embodiments, the top surface of the outsole is flat except for the longitudinal ribs.

In some embodiments, the notches are not interconnected. In some embodiments, a bottom surface of the outsole does not define any notches located opposite the longitudinal ribs. In some embodiments, a top surface of the midsole does not have any longitudinal ribs located opposite the notches.

In some embodiments, a sole for an article of footwear includes an outsole that has longitudinal ribs on its top surface and a midsole that defines notches that complementarily fit over the longitudinal ribs.

In some embodiments, the longitudinal ribs are disposed in a forefoot region of the sole. In some embodiments, the sole promotes a quicker transition to a forefoot of the sole during a gait cycle of a wearer. In some embodiments, the longitudinal ribs disposed in the notches stiffen the sole. In some embodiments, the outsole defines a pattern of holes extending through the outsole. In some embodiments, the holes are disposed in rows. In some embodiments, the rows of holes are disposed between the longitudinal ribs.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION

Figure 1:
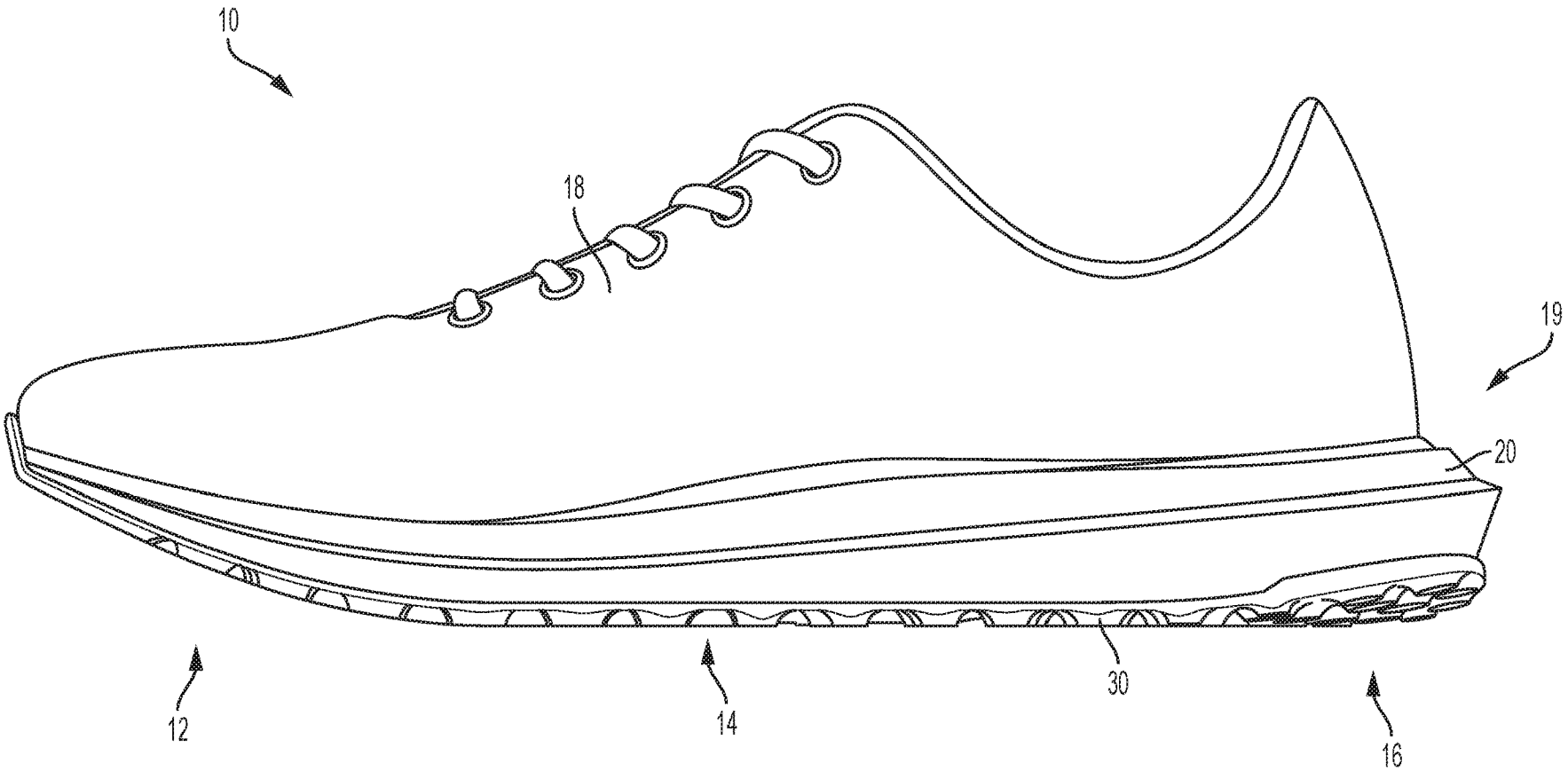
FIG. 1 shows a lateral side view of an article of footwear according to some embodiments.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention provide articles of footwear having a ribbed outsole and a notched midsole. The ribbed outsole and notched midsole provide regulated flexion and stiffness in one or more regions of the foot. The outsole comprises a plurality of longitudinal ribs in one or more regions of the outsole. In some embodiments, the longitudinal ribs are disposed on a top surface of the outsole.

The midsole defines a plurality of notches that are configured to receive the longitudinal ribs. In some embodiments, the midsole is disposed above the outsole and the notches are disposed on a bottom surface of the midsole.

The interaction between the notches and the ribs may stiffen the sole (e.g., the outsole and/or the midsole) in the regions where the notches and ribs are located (e.g., in the mid to forefoot region under the metatarsal phalangeal joint (MTP) of the foot). In some embodiments, replacing midsole material volume with outsole material volume (i.e., adding ribs and notches) may stiffen the outsole. In some embodiments, the interaction between the notches and ribs may indirectly stiffen the midsole. The notches and ribs may also create a geometry that facilitates rocking (i.e., from back to front). Thus, the article of footwear may promote a quicker transition to the forefoot and thereby enhance the propulsive phase of a wearer's movement. Soles that use notches and ribs to provide the regulated flexion and stiffness are easy to create and manufacture and may also be easy to customize and/or adjust for a particular wearer.

In some embodiments, an article of footwear 10, as shown, for example, in FIG. 1, comprises a forefoot region 12, a midfoot region 14, and a rearfoot region 16. Article of footwear 10 may comprise an upper 18. Any suitable upper may be used as upper 18. Article of footwear 10 comprises a sole 19 that includes a midsole 20 and an outsole 30. In some embodiments, upper 18 is coupled to midsole 20. For example, upper 18 may be stitched, bonded, or adhered to midsole 20. In some embodiments, midsole 20 is coupled to outsole 30. For example, midsole 20 may be directly bonded to outsole 30. Alternatively, midsole 20 may be adhered to outsole 30 with an adhesive. In some embodiments, midsole 20 is made of expanded thermoplastic polyurethane particle foam (e-TPU).

Figure 2:
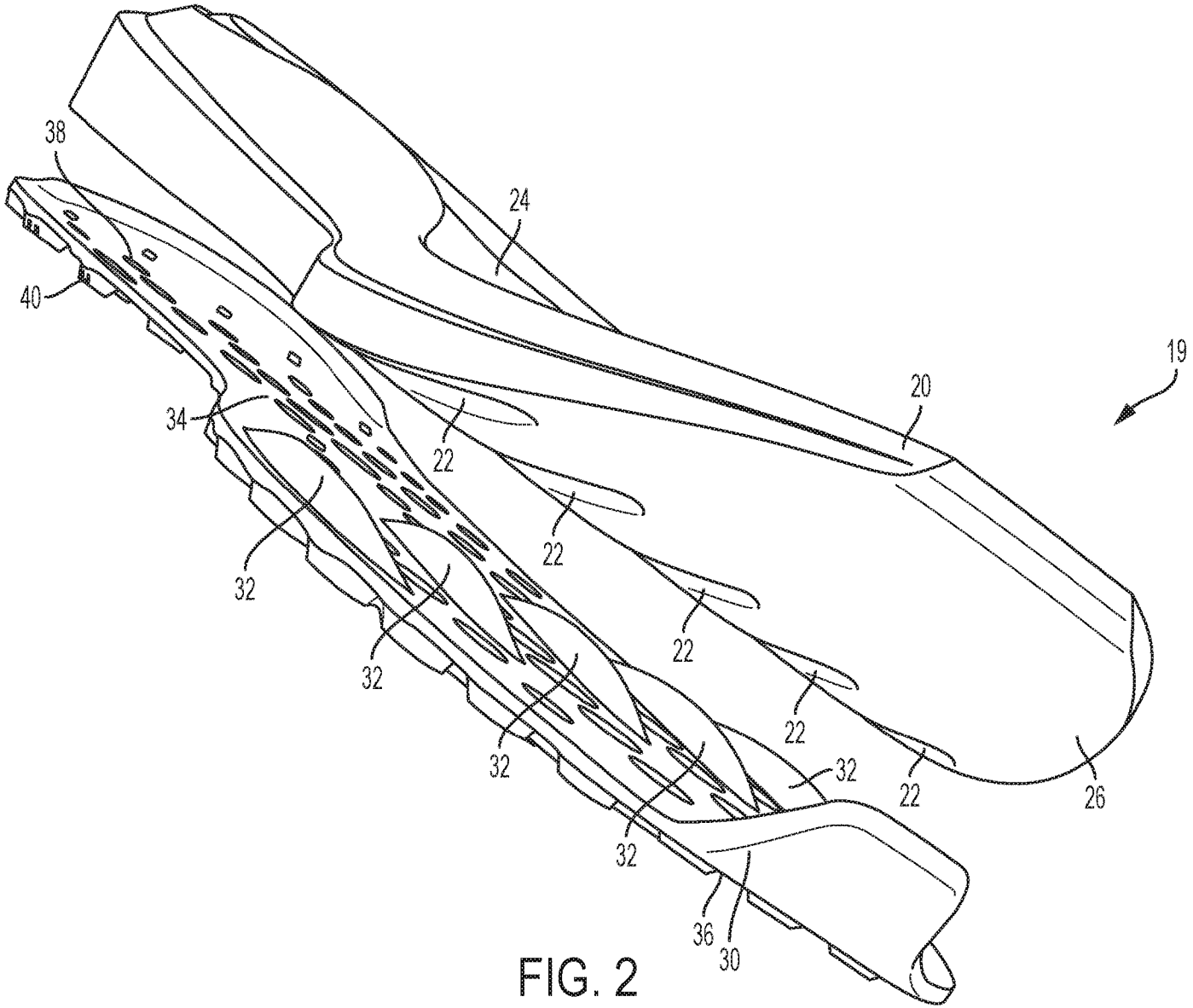
FIG. 2 shows an exploded perspective view of a sole for an article of footwear according to some embodiments.

In some embodiments, midsole 20 is disposed above outsole 30, as shown, for example, in FIG. 2. A top surface 34 of outsole 30 may correspond to a bottom surface 26 of midsole 20. For example, outsole 30 may include one or more structures that extend from top surface 34 and midsole 20 may define one or more voids in bottom surface 26 that correspond to the structures.

In some embodiments, outsole 30 comprises longitudinal ribs 32 that extend from top surface 34. Longitudinal ribs 32 extend in the longitudinal direction of article of footwear 10, such that the length of longitudinal ribs 32 is greater than the width of longitudinal ribs 32. In some embodiments, longitudinal ribs 32 have a varying height along their length (see FIG. 5). For example, a top surface of longitudinal ribs 32 may be curved with a greatest height of longitudinal ribs 32 at or near the center of the length of longitudinal ribs 32 and extending gradually down to top surface 34 of outsole 30 at the ends of longitudinal ribs 32. In some embodiments, a top surface of longitudinal ribs 32 may be domed. This configuration may contribute to the rocking function that promotes a quicker transition to the forefoot and thereby enhances the propulsive phase of a wearer's movement. For example, the curved geometry of longitudinal ribs 32 supports a quicker foot roll in a minimalistic way when longitudinal ribs 32 are located precisely under the MTP-joints, which is where the forefoot transition toward the propulsive toe-off occurs. In some embodiments, longitudinal ribs 32 have a higher hardness than midsole 20 (e.g., an e-TPU midsole), which together with the longitudinal ribs' 32 curvature may create "mini" rockers. The rockers naturally promote displacement from their unstable apex of the curve to a more neutral (at rest) position, thus helping a wearer to get to the toe-off phase. Other shapes and heights may also be used for longitudinal ribs 32.

Longitudinal ribs 32 may be disposed in a variety of locations on top surface 34 of outsole 30. In some embodiments, longitudinal ribs 32 are disposed in midfoot region 14. In some embodiments, longitudinal ribs 32 are disposed in forefoot region 12. Longitudinal ribs 32 may extend from midfoot region 14 to forefoot region 12. For example, longitudinal ribs 32 may be disposed under the metatarsal phalangeal joint (MTP) of the foot. In some embodiments, longitudinal ribs 32 are disposed only in forefoot region 12. In some embodiments, longitudinal ribs 32 are disposed separately in multiple regions. For example, a first set of longitudinal ribs 32 may be disposed in midfoot region 14 with a second set of longitudinal ribs 32 disposed in rearfoot region 16. Other configurations are also possible. For example, in some embodiments, outsole 30 may include diagonal ribs and/or transversal ribs. Such diagonal ribs and/or transversal ribs may be located in forefoot region 12, midfoot region 14, and/or rearfoot region 16. Diagonal ribs and/or transversal ribs may correspond to the notches shown in FIGS. 9 and 10, as discussed below. In some embodiments, longitudinal ribs 32 extend from rearfoot region 16 to forefoot region 12.

Figure 3:
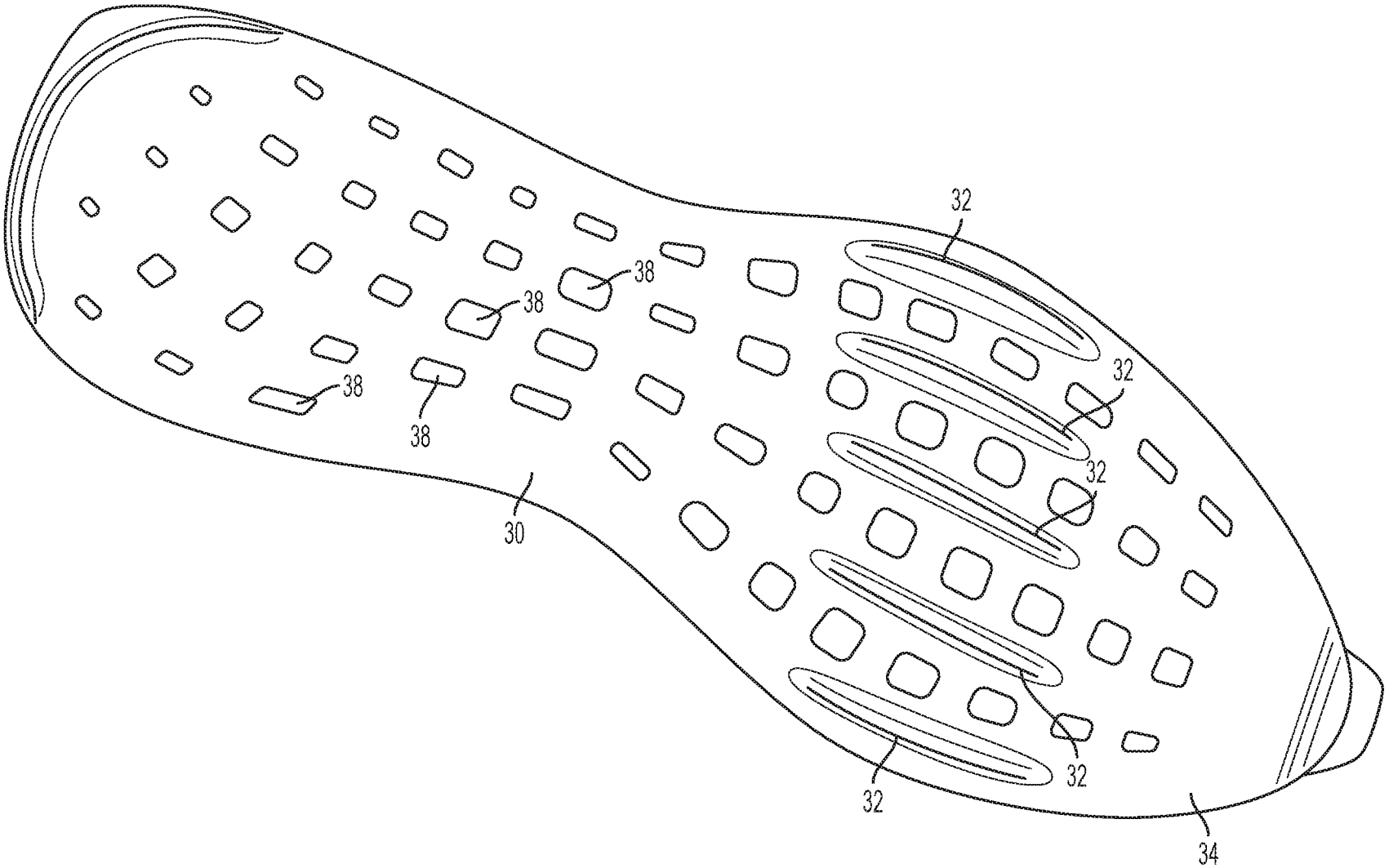
FIG. 3 shows a top view of an outsole for an article of footwear according to some embodiments.
Figure 4:
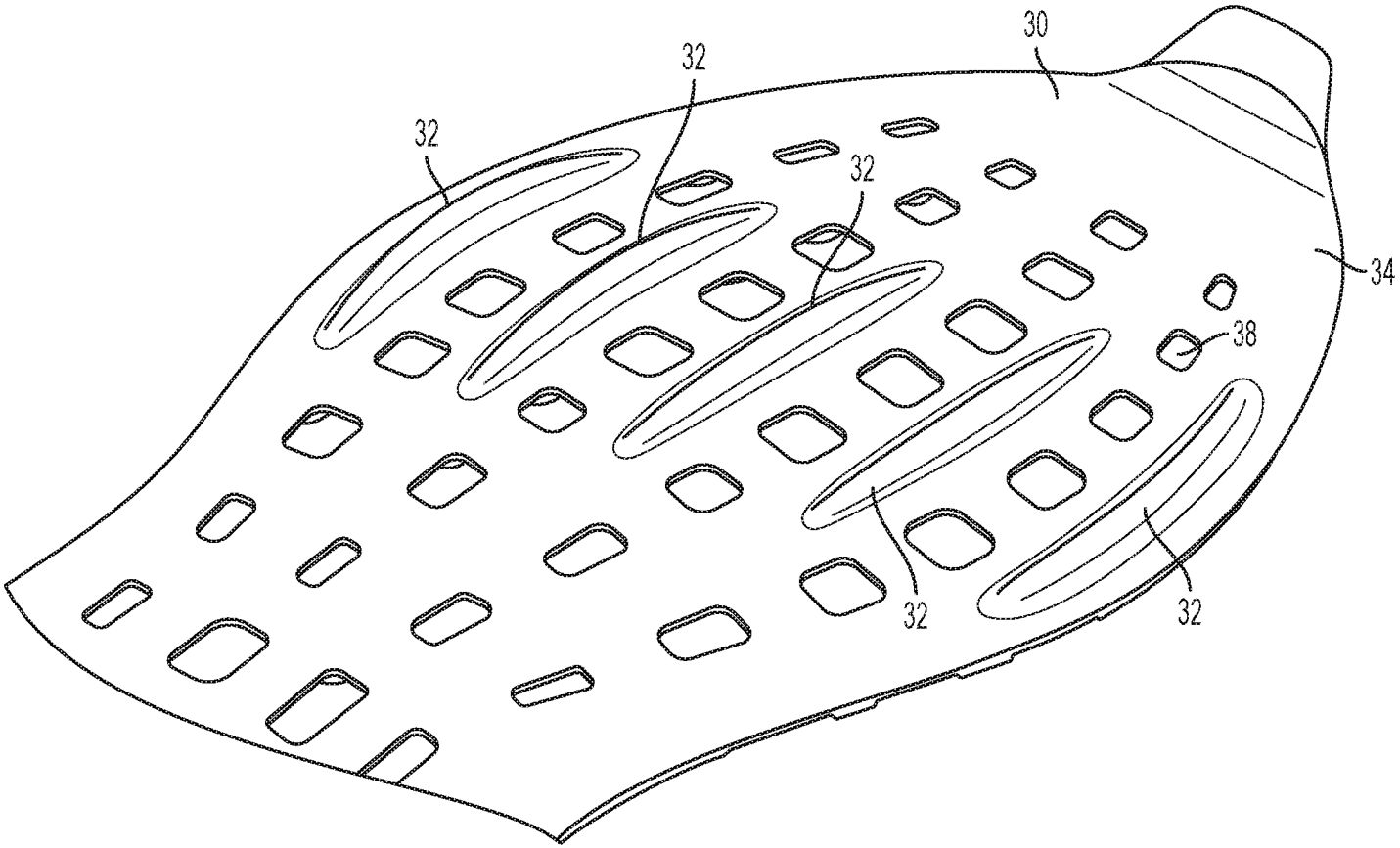
FIG. 4 shows a perspective view of a portion of an outsole for an article of footwear according to some embodiments.
Figure 5:
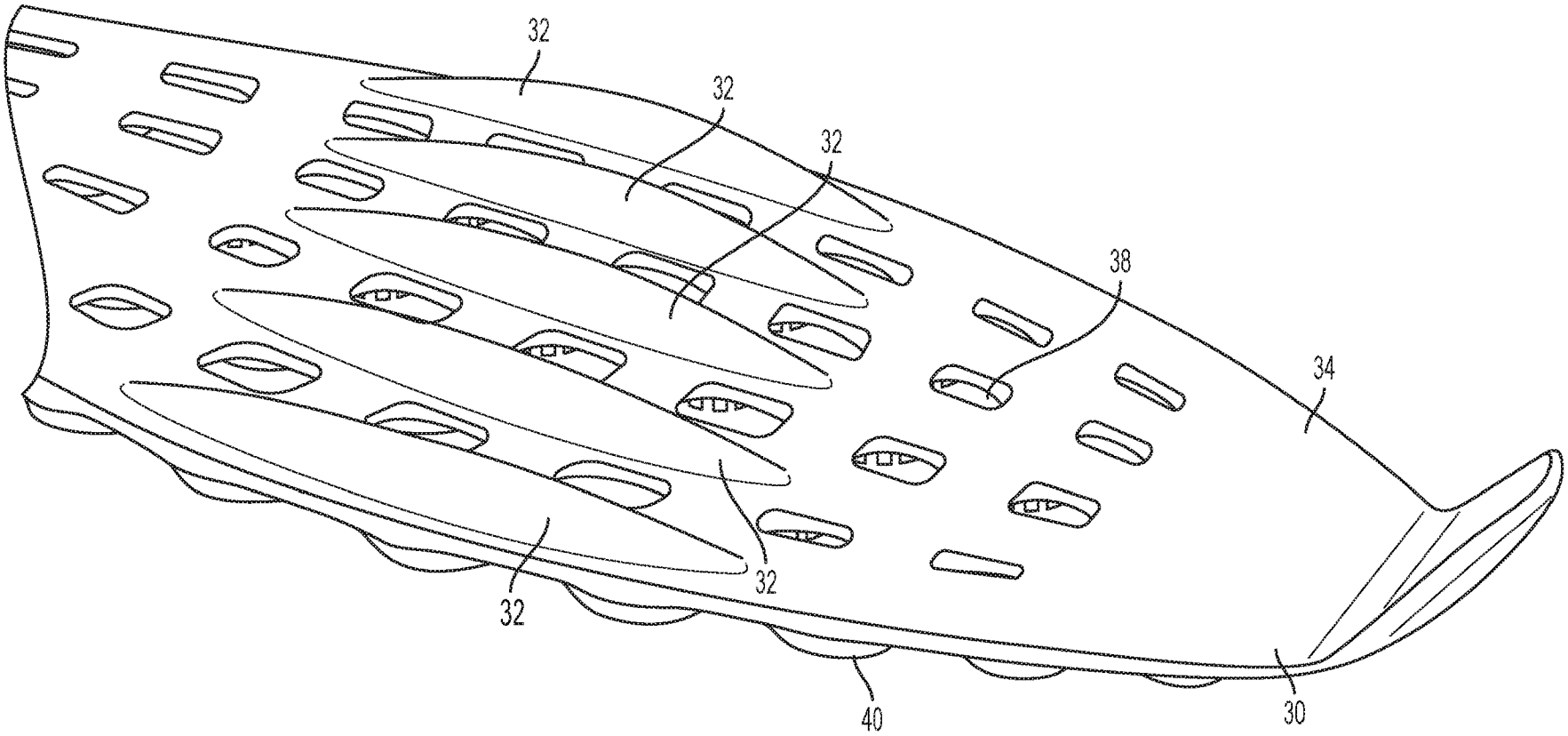
FIG. 5 shows a perspective view of a portion of an outsole for an article of footwear according to some embodiments.

In some embodiments, longitudinal ribs 32 are disposed parallel to each other. A set of longitudinal ribs 32 may be disposed spaced apart from each other across a width of outsole 30 (e.g., in the midfoot region 14 and/or forefoot region 12), as shown, for example, in FIG. 3. In some embodiments, outsole 30 includes at least three longitudinal ribs 32. For example, as shown in FIGS. 3-5, outsole 30 includes five longitudinal ribs 32. A different amount of longitudinal ribs 32 may be used (e.g., two, four, or more than five). In some embodiments, the dispersion of longitudinal ribs 32 across the width of forefoot region 12 help restrain the displacement of midsole 20 transversally during compression and loading. For example, longitudinal ribs 32 may compartment the bottom surface of midsole 20 into narrowed areas to limit transversal movement and displacement. In some embodiments, limiting some of the midsole transversal movements and displacements across the sole helps provide more foot stability during curvilinear running, sudden changes of direction (cuts), or hard lateral breaking.

In some embodiments, longitudinal ribs 32 each have the same length. Alternatively, longitudinal ribs 32 may have different lengths from each other. In some embodiments, the ends of longitudinal ribs 32 are aligned with each other along the longitudinal direction of article of footwear 10. In some embodiments, the ends of longitudinal ribs 32 may not be aligned (see FIG. 3).

In some embodiments, longitudinal ribs 32 are an integral, monolithic part of outsole 30. Thus, longitudinal ribs 32 may be integrally molded with outsole 30. Accordingly, ribbed outsole 30 is easy to manufacture.

In some embodiments, top surface 34 of outsole 30 is flat except for longitudinal ribs 32. For example, longitudinal ribs 32 are not interconnected (e.g., with transverse ribs or other projecting structures). In some embodiments, a bottom surface 36 of outsole 30 does not define any notches located opposite longitudinal ribs 32.

In some embodiments, outsole 30 defines a pattern of holes 38 extending through outsole 30, as shown, for example, in FIGS. 3-5. Holes 38 may be disposed in rows. For example, the rows of holes 38 may be disposed between longitudinal ribs 32. In some embodiments, holes 38 vary in size and shape. Holes 38 may, for example, be circular, square, rectangular, or oval.

Figure 6:
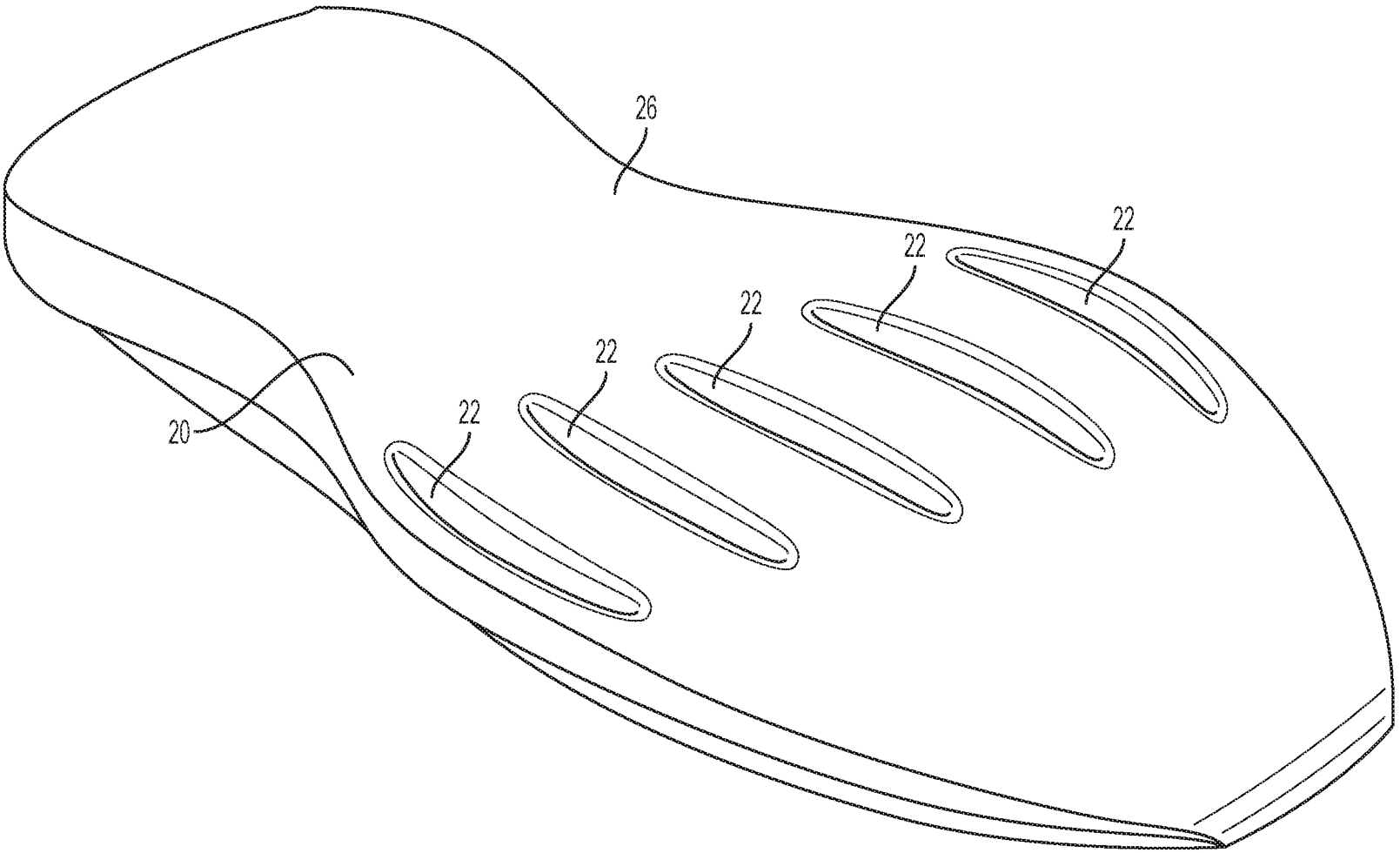
FIG. 6 shows a perspective view of a midsole for an article of footwear according to some embodiments.
Figure 7:
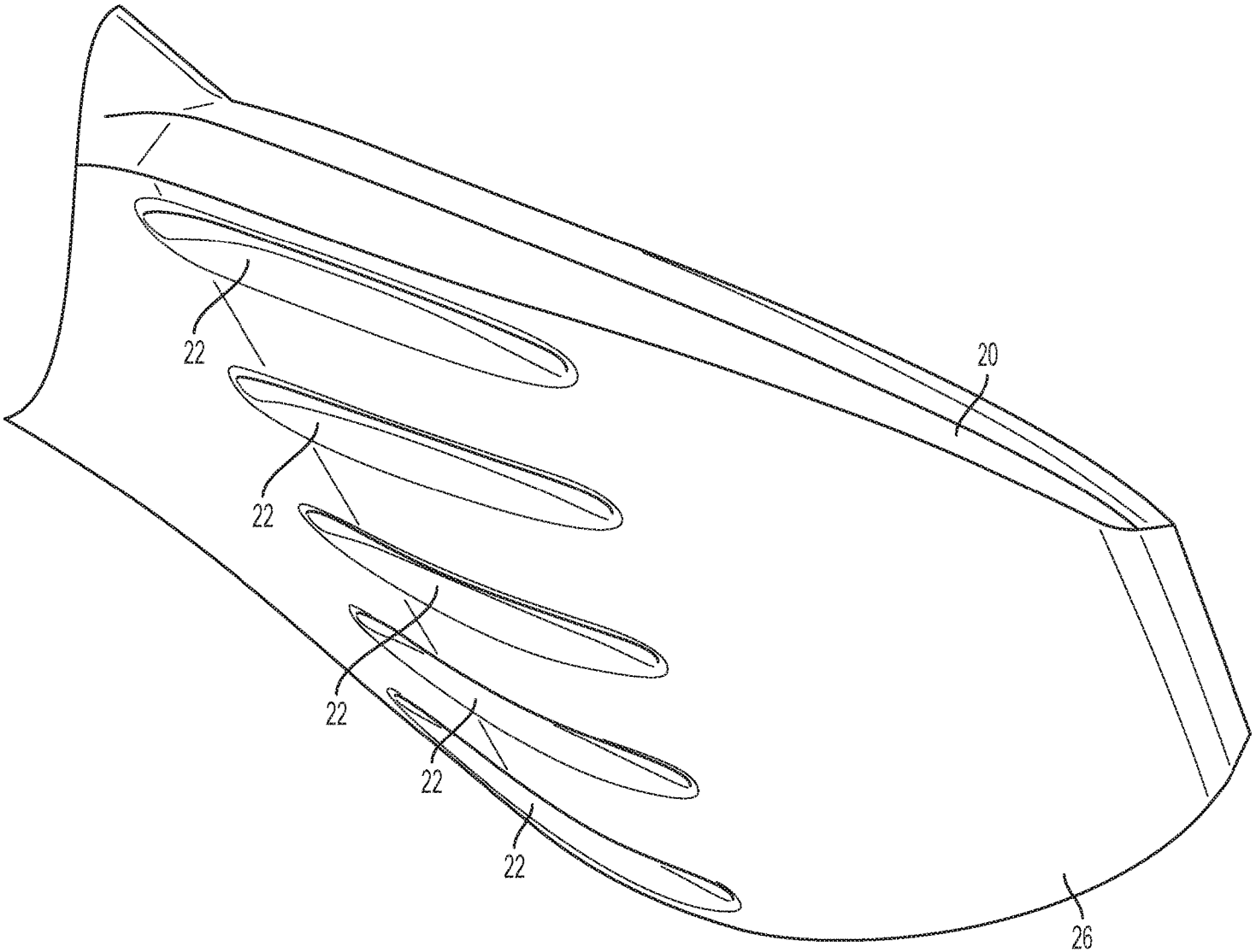
FIG. 7 shows a perspective view of a portion of a midsole for an article of footwear according to some embodiments.

In some embodiments, midsole 20 defines notches 22 in bottom surface 26 of midsole 20 that correspond to longitudinal ribs 32, as shown, for example, in FIGS. 2, 6, and 7. Notches 22 are configured to complementarily fit over longitudinal ribs 32. Thus, when article of footwear 10 is fully assembled (see FIG. 1), longitudinal ribs 32 are disposed within notches 22. In some embodiments, longitudinal ribs 32 completely fill notches 22. In some embodiments, longitudinal ribs 32 disposed in notches 22 stiffen the sole assembly (e.g., outsole 30 and/or midsole 20). In some embodiments, the interaction between notches 22 and ribs 32 may stiffen the entire sole assembly due to outsole 30 stiffening by adding ribs 32 and notches 22. In some embodiments, midsole 20 may be indirectly stiffened. When longitudinal ribs 32 are located under the MTP joint, the complementary notches 22 provide more stretch resistance in the longitudinal direction (of the wearer's gait) thus assisting the function of the foot ligaments in the metatarsal joints. With longitudinal ribs 32, the cushioning of midsole 20 may be soft and comfortable while outsole 30 stores and returns more energy during the propulsive phase of the gait (by resisting elongation) than it would without longitudinal ribs 32. By stiffening outsole 30, the wearer can thereby run faster. Sole 19 may be configured to promote a quicker transition to a forefoot during a gait cycle of the wearer.

In some embodiments, notches 22 extend in the longitudinal direction of article of footwear 10, such that the length of notches 22 is greater than the width of notches 22. In some embodiments, notches 22 have a varying depth along their length (see FIG. 7). For example, a surface of notches 22 may be curved with a greatest depth of notches 22 at or near the center of the length of notches 22 and extending gradually down to bottom surface 26 of midsole 20 at the ends of notches 22. This configuration may contribute to the rocking function that promotes a quicker transition to the forefoot and thereby enhances the propulsive phase of a wearer's movement. For example, the curved geometry supports a quicker foot roll, as discussed above with respect to longitudinal ribs 32. Other shapes and depths may also be used for notches 22.

Figure 9:
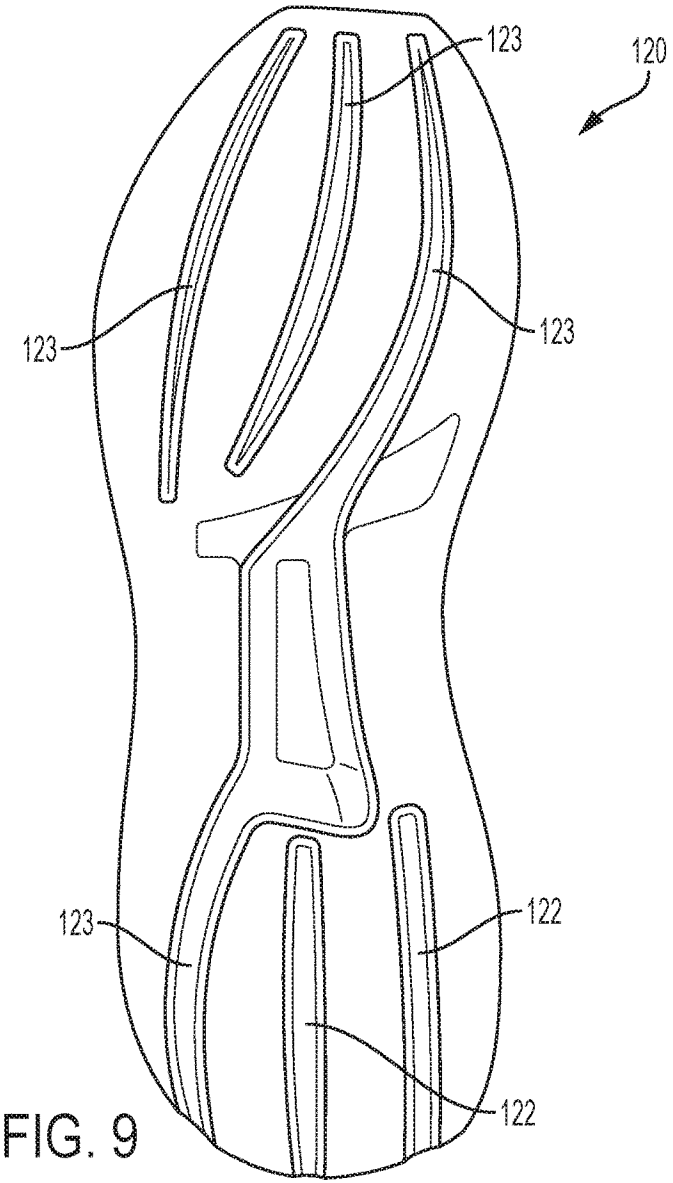
FIG. 9 shows a bottom view of a midsole for an article of footwear according to some embodiments.
Figure 10:
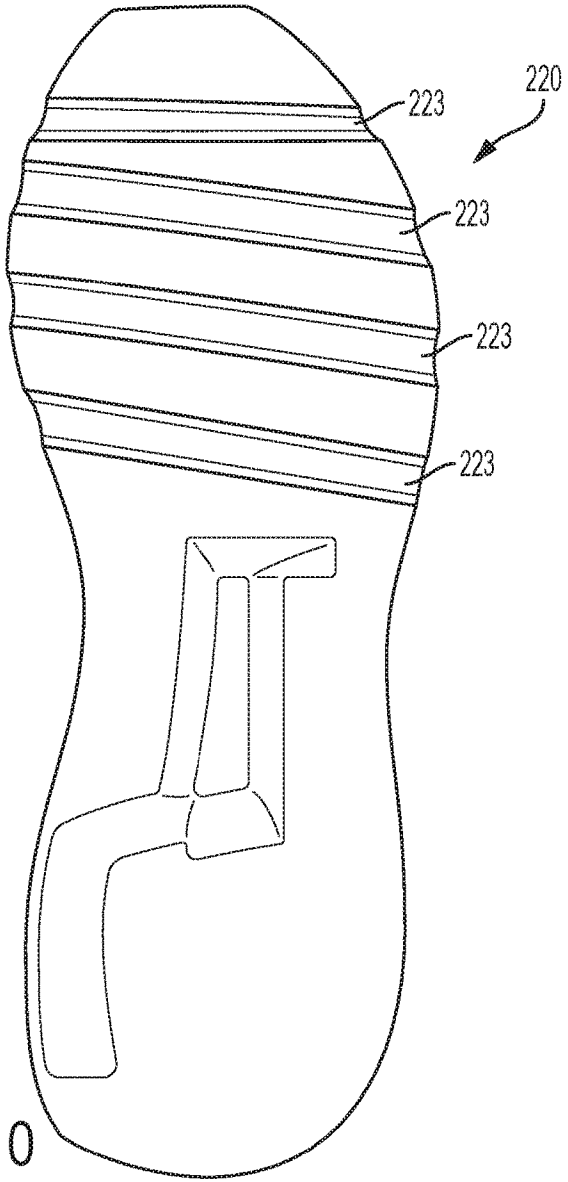
FIG. 10 shows a bottom view of a midsole for an article of footwear according to some embodiments.

Notches 22 may be disposed in a variety of locations on bottom surface 26 of midsole 20. In some embodiments, notches 22 are disposed in midfoot region 14. In some embodiments, notches 22 are disposed in forefoot region 12. Notches 22 may extend from midfoot region 14 to forefoot region 12. In some embodiments, notches 22 are disposed only in forefoot region 12. In some embodiments, notches 22 are disposed separately in multiple regions. For example, a first set of notches 22 may be disposed in midfoot region 14 with a second set of notches 22 disposed in rearfoot region 16. Other configurations are also possible. For example, in some embodiments, as shown in FIG. 9, a midsole 120 includes a combination of diagonal notches 123 and longitudinal notches 122. In some embodiments, diagonal notches 123 may be disposed in a forefoot region and/or a rearfoot region, as shown in FIG. 9. Diagonal notches 123 may also be disposed in a midfoot region. In some embodiments, longitudinal notches 122 may be disposed in a rearfoot region together with diagonal notches 123. In some embodiments, as shown, for example, in FIG. 10, a midsole 220 includes transversal notches 223. In some embodiments, transversal notches 223 are disposed in a forefoot region. Such transversal notches 223 may also or alternatively be located in a midfoot region and/or a rearfoot region. Any combination of diagonal notches 123, longitudinal notches 122, and transversal notches 223 may be disposed in a midsole, with corresponding ribs in an outsole. In some embodiments, notches 22 extend from rearfoot region 16 to forefoot region 12.

In some embodiments, notches 22 are disposed parallel to each other. A set of notches 22 may be disposed spaced apart from each other across a width of midsole 20 (e.g., in the midfoot region 14 and/or forefoot region 12), as shown, for example, in FIGS. 6 and 7. In some embodiments, midsole 20 includes at least three notches 22. For example, as shown in FIGS. 6 and 7, midsole 20 includes five notches 22. A different amount of notches 22 may be used (e.g., two, four, or more than five).

In some embodiments, notches 22 each have the same length. Alternatively, notches 22 may have different lengths from each other. In some embodiments, the ends of notches 22 are aligned with each other along the longitudinal direction of article of footwear 10. In some embodiments, the ends of notches 22 may not be aligned.

In some embodiments, notches 22 are formed during a molding process of midsole 20, which facilitates easy manufacture of article of footwear 10.

In some embodiments, bottom surface 26 of midsole 20 is flat except for notches 22. For example, notches 22 are not interconnected (e.g., with transverse notches). In some embodiments, a top surface 24 of midsole 20 does not have longitudinal ribs located opposite notches 22.

Figure 8:
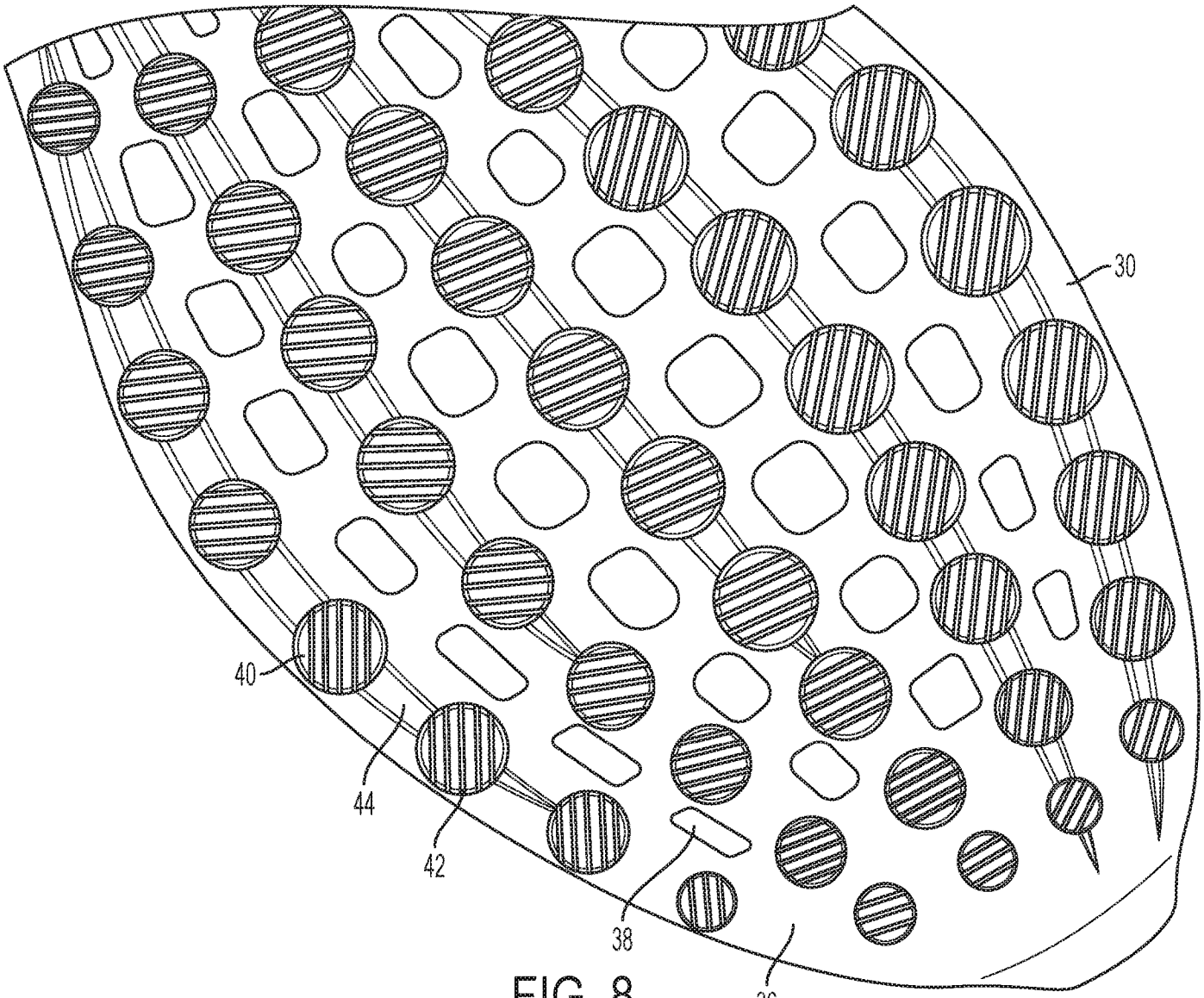
FIG. 8 shows a bottom view of a portion of an outsole for an article of footwear according to some embodiments.

In some embodiments, as shown, for example, in FIG. 8, outsole 30 comprises projections 40 extending from bottom surface 36. Projections 40 may be disposed in one or more rows. In some embodiments, rows of projections 40 are disposed between rows of holes 38. In some embodiments, projections 40 define a plurality of grooves 42 disposed on a ground-contacting surface of projections 40, which may provide increased traction for article of footwear 10. In some embodiments, projections 40 in each row are connected with connecting members 44 that extend from bottom surface 36 of outsole 30. In some embodiments, connecting members 44 contribute to stiffening the outsole by providing more stretch resistance in the longitudinal direction. In some embodiments, connecting members 44 help outsole 30 store and return more energy during the propulsive phase of the gait (by resisting elongation) than it would without connecting members 44. By stiffening outsole 30, the wearer can thereby run faster.

Various embodiments described herein provide an article of footwear with a ribbed outsole and notched midsole. The interaction between the notches and the ribs may stiffen the sole (e.g., outsole 30 and/or midsole 20) in the regions where the notches and ribs are located and create a geometry that facilitates rocking (i.e., from back to front). Thus, the article of footwear may promote a quicker transition to the forefoot and thereby enhance the propulsive phase of a wearer's movement. In addition, dispersing ribs across the width of the outsole may help restrain the displacement of the midsole transversally during compression and loading by compartmenting the midsole bottom surface in narrowed areas. Limiting some of the midsole transversal movements and displacements across the sole helps provide more foot stability during curvilinear running, sudden changes of direction (cuts), or hard lateral breaking. Soles that use notches and ribs to provide the regulated flexion and stiffness are easy to create and manufacture and may also be easy to customize and/or adjust for a particular wearer.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A sole for an article of footwear, the sole comprising:

an outsole comprising longitudinal ribs arranged on a top surface of the outsole, wherein each of the longitudinal ribs comprises a top surface that is curved; and a midsole disposed above the outsole and defining notches in a bottom surface of the midsole, wherein the longitudinal ribs are disposed in the notches;

wherein the sole comprises a forefoot region, a midfoot region, and a rearfoot region, and wherein the longitudinal ribs are disposed in a forefoot region of the sole and no longitudinal ribs are disposed rearward of the forefoot region.

2. The sole of claim 1, wherein the longitudinal ribs comprises five longitudinal ribs arranged to be disposed under metatarsophalangeal joints of a foot.

3. The sole of claim 1, wherein the longitudinal ribs have an equal length to each other.

4. The sole of claim 1, wherein at least one of the longitudinal ribs has a length different than another longitudinal rib of the logitudinal ribs.

5. The sole of claim 1, wherein the longitudinal ribs are configured to facilitate forward motion of a foot of a wearer.

6. An article of footwear comprising:

an upper;

a midsole coupled to the upper and defining notches in a bottom surface of the midsole; and an outsole coupled to the midsole and comprising longitudinal ribs extending from a top surface of the outsole, wherein each of the longitudinal ribs comprises a top surface that is curved such that the top surface slopes from a maximum height at a center of the longitudinal rib towards the top surface of the outsole at ends of the longitudinal rib, and wherein each longitudinal rib is disposed in one of the notches of the midsole;

wherein the longitudinal ribs are disposed in a forefoot region of the article of footwear and no longitudinal ribs are disposed rearward of the forefoot region.

7. The article of footwear of claim 6, wherein the notches are not interconnected.

8. The article of footwear of claim 6, wherein a bottom surface of the outsole does not define any notches located opposite the longitudinal ribs.

9. The article of footwear of claim 6, wherein a top surface of the midsole does not have any longitudinal ribs located opposite the notches.

10. A sole for an article of footwear, the sole comprising:

an outsole comprising a plurality of longitudinal ribs on a top surface of the outsole, wherein the outsole comprises a forefoot region, a midfoot region, and a rearfoot region, and wherein each of the plurality of longitudinal ribs are arranged at the forefoot region of the outsole and no longitudinal ribs are arranged rearward of the forefoot region; and a midsole defining notches configured to complementarily fit over the plurality of longitudinal ribs.

11. The sole of claim 10, wherein the sole is configured to promote a quicker transition to a forefoot of the sole during a gait cycle of a wearer.

12. The sole of claim 10, wherein the plurality of longitudinal ribs disposed in the notches stiffen the sole.

13. The sole of claim 10, wherein the outsole defines a pattern of holes extending through the outsole.

14. The sole of claim 13, wherein the pattern of holes are disposed between the plurality of longitudinal ribs.

15. The sole of claim 10, wherein a longitudinal rib of the plurality of longitudinal ribs is disposed under a metatarsophalangeal joint of a foot of a wearer.

* * * * *